United States Patent [19]

Beamenderfer et al.

[11] Patent Number: 4,984,992

[45] Date of Patent: Jan. 15, 1991

[54] CABLE CONNECTOR WITH A LOW INDUCTANCE PATH

[75] Inventors: Robert E. Beamenderfer, Palmyra; Raymond R. Buchheister, Jr., Fairfield; John R. Ellis, Harrisburg; Charles A. Miller, York New Salem; Stanford C. Moist, Jr., Hummelstown; William E. Zelko, Dauphin, all of Pa.

[73] Assignee: AMP Incorporated, Harrisburg, Pa.

[21] Appl. No.: 430,701

[22] Filed: Nov. 1, 1989

[51] Int. Cl.[5] ..... H01R 13/648

[52] U.S. Cl. ..... 439/108; 439/608; 439/101

[58] Field of Search ..... 439/92, 101, 108, 608

[56] References Cited

U.S. PATENT DOCUMENTS

| | | | |
|---|---|---|---|
| 3,149,893 | 9/1984 | Dupre | 339/14 |
| 4,215,236 | 7/1980 | Reiser | 174/59 |
| 4,310,208 | 1/1982 | Webster | 339/14 R |
| 4,379,361 | 4/1983 | Webster et al. | 29/857 |
| 4,506,940 | 3/1985 | Asick et al. | 339/17L C |
| 4,558,917 | 12/1985 | Kamone et al. | 339/143 R |
| 4,571,014 | 2/1986 | Robin et al. | 339/14 R |
| 4,587,028 | 10/1971 | Uberbacher | 339/14 |
| 4,602,831 | 7/1986 | Lockard | 339/14 R |
| 4,611,867 | 9/1986 | Ichimura et al. | 339/14 R |
| 4,632,476 | 12/1986 | Schell | 339/14 R |
| 4,655,515 | 4/1987 | Hamsher et al. | 339/14 R |
| 4,655,518 | 4/1987 | Johnson et al. | 339/17 LC |
| 4,707,040 | 11/1987 | Hansel, III | 439/510 |
| 4,711,506 | 12/1987 | Tanaka | 439/108 |
| 4,712,849 | 12/1987 | Seidel et al. | 439/607 |
| 4,747,787 | 5/1988 | Siwinski | 439/108 |
| 4,762,500 | 8/1988 | Dola et al. | 439/79 |
| 4,773,881 | 9/1988 | Adams, III | 439/681 |
| 4,808,115 | 2/1989 | Norton et al. | 439/79 |
| 4,846,727 | 7/1989 | Glover et al. | 439/608 |
| 4,867,707 | 9/1989 | Widdoes | 439/675 |
| 4,869,677 | 9/1989 | Johnson et al. | 439/80 |

FOREIGN PATENT DOCUMENTS 2027290 2/1980 United Kingdom .

OTHER PUBLICATIONS

"IBM Technical Disclosure Bulletin," Shielded In--Line Electrical Multiconnector, vol. 10, No. 3, Aug. 1967, p. 203.

"The Demands of Logic and Power on Back Planes" Electronic Engineering 60 (1988) Apr., No. 736.

*Primary Examiner*—Gary F. Paumen

*Attorney, Agent, or Firm*—Gerald K. Kita

[57] ABSTRACT

A cable 3 connector 1 comprising, a housing block 2 and an electrical cable 3 having a signal wire 13 connected to a corresponding signal contact 4, and at least one reference wire 14 connected to a reference conductor 5 extending beside the signal contact 4, a housing 6 coupled to the housing 6 block 2 and receiving the signal contact 4 in one of multiple contact positions 7 in the housing 6, and a reference contact 10 received in the housing 6 and connected to the reference conductor 5.

21 Claims, 6 Drawing Sheets

Fig. 5
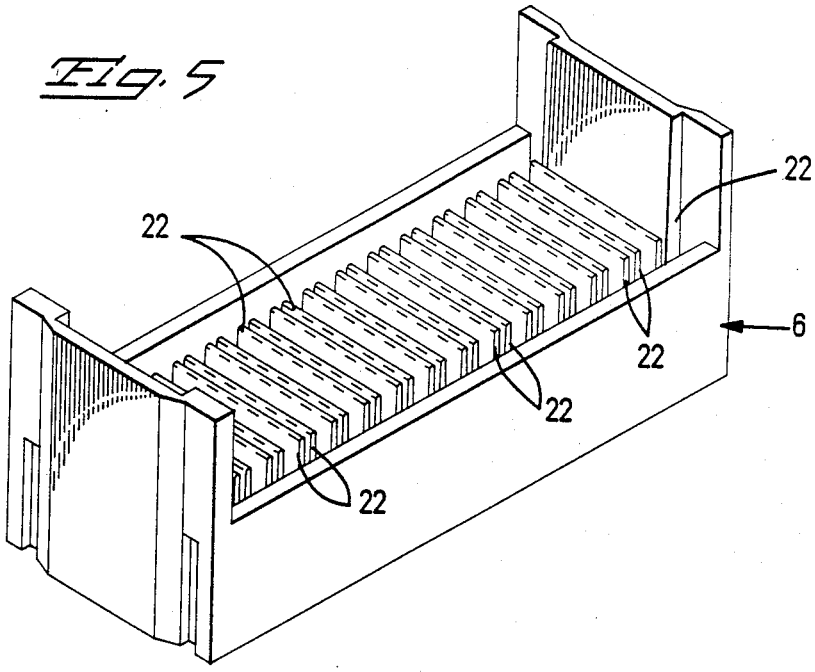
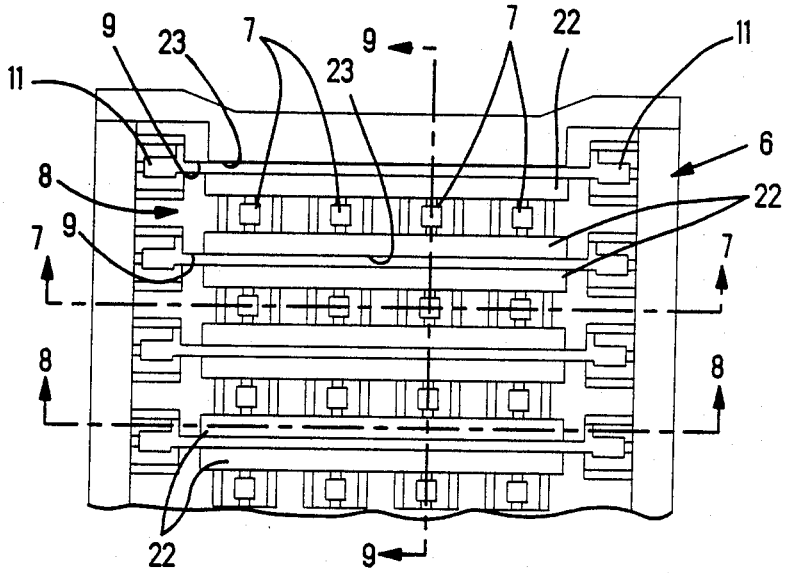
Fig. 6

CABLE CONNECTOR WITH A LOW INDUCTANCE PATH

FIELD OF THE INVENTION

The specification describes a cable connector and more particularly, a cable connector with a low inductance signal return path.

BACKGROUND OF THE INVENTION

A known cable connector is disclosed in U.S. Pat. 4,602,831 and comprises, a housing block and an electrical cable having at least one signal wire connected to a corresponding signal contact on the housing block, and at least one reference wire of the cable for connection to a reference electrical potential. The signal wires transmit electrical signals, either electrical power or electrical encoded signals. The reference electrical potential is ground voltage. Along the cable a reference conductor shields the signal wires from undesired influence, such as electrostatic and electromagnetic coupling. In one form of cable, the reference conductor is a conductive shield that encircles a corresponding signal wire. A reference wire in contact with the shield connects to the connector and to a reference electrical potential present in the connector.

As the switching speeds of the signals become faster, there is a need for the signal contacts to become closer together, to shorten signal transmission paths between signal contacts, and to reduce an allocation of valuable space to be consumed by the contact spacing. The signal contacts are too close if they couple inductively and electrostatically, and produce cross talk and impedance mismatch.

As the switching speeds of the signals become faster, a further need exists to provide a low inductance return path in the connector, to control common impedance noise generation, and to establish coupling of each signal contact electromagnetically and electrostatically to the return path that is stronger than a similar coupling to other signal conductors, and to provide an impedance that matches the impedance of other parts of electrical circuits transmitting the signals, in order to reduce signal reflections. However, such a return path in the connector consumes additional space, and imposes a limit upon the closeness of the signal contacts. Thus a choice is presented, whether to eliminate a return path and risk undesired impedance mismatch and undesired coupling, or whether to provide adequate return paths and sacrifice valuable space to be consumed by increasing the contact spacing and by enlarging the connector.

SUMMARY OF THE INVENTION

A feature of the invention resides in a cable connector comprising, a housing coupled to a housing block and receiving a signal contact on the housing block in one of multiple contact positions in the housing, a reference contact being received in the housing and being connected to the reference conductor, and the reference conductor extending in the housing and beside each one of the multiple contact positions. An advantage of the invention is that the reference conductor extends a low inductance signal return path into the housing and beside each signal contact received in a corresponding one of the contact positions. Another advantage of the invention is that the multiple contact positions can be close together, since they provide multiple choices for spacing apart signals that would be too close together if routed to directly adjacent contact positions. Another advantage of the invention resides in a cable connector that combines close together signal contact positions with a low inductance signal return path extending from a housing block to a housing and beside contact positions in the housing.

According to the known cable connector disclosed in U.S. Pat. 4,602,831 fronts of the signal contacts extend beyond a front of a ground contact and thereby lack coupling to an adjacent low inductance signal return path.

Another feature of the invention resides in a cable connector having a reference conductor that extends uncovered along a housing block for nesting directly against another housing block on which are additional signal contacts The advantages are, that the housing blocks are close together, and the signal contacts on the housing blocks are directly adjacent and close together without undue coupling with one another, because the reference conductor provides a common return path for signal contacts on one housing block, and provides a shield for each signal contact on the one housing block from each signal contact on the adjacent housing block.

The invention will now be described by way of example with reference to the accompanying drawings.

DESCRIPTION OF THE DRAWINGS

In the drawings.

FIG. 5 is a perspective view of a housing.

FIG. 6 is a fragmentary plan view of the housing shown in FIG. 5.

DETAILED DESCRIPTION

Figure 1:
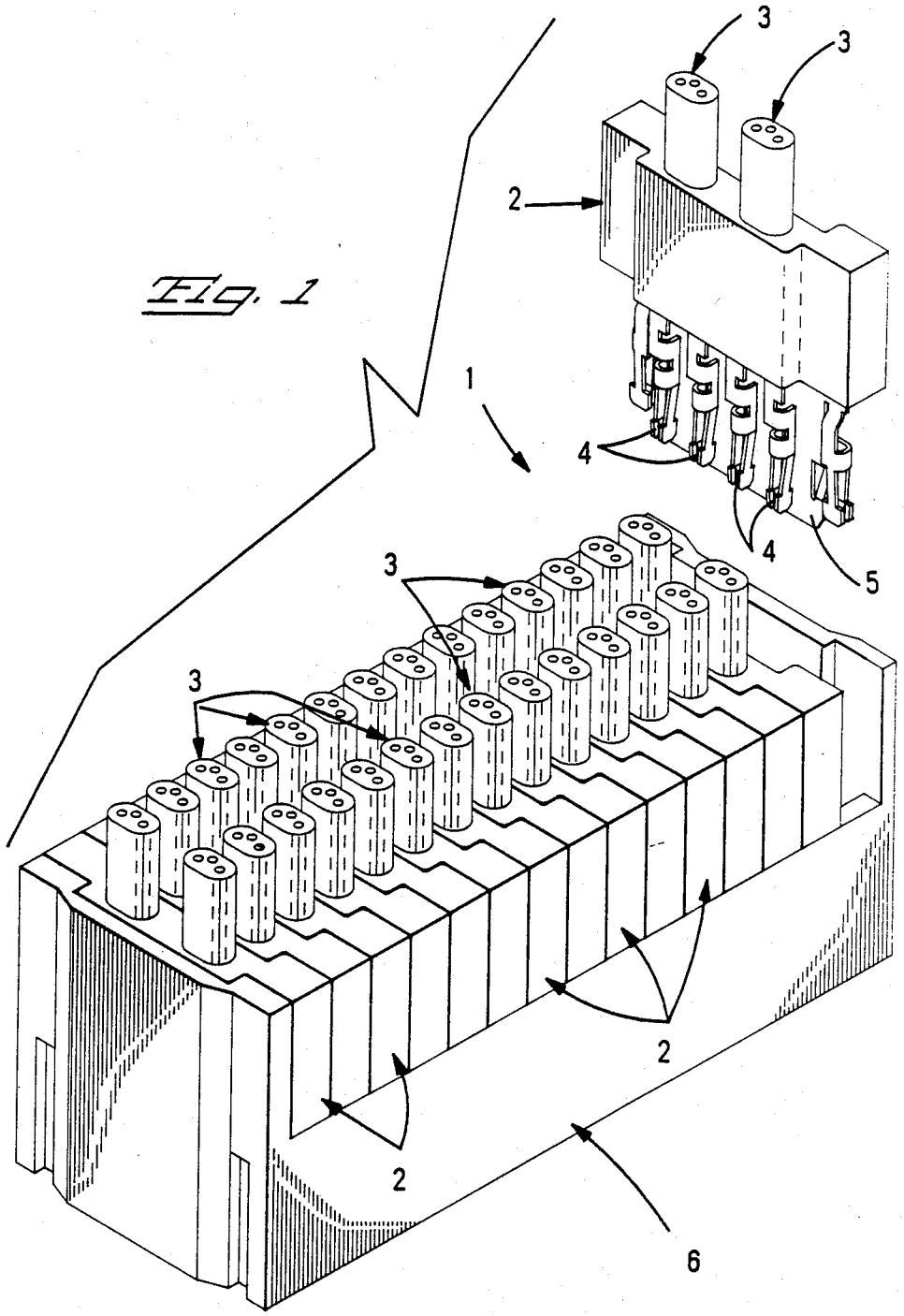
FIG. 1 is a perspective view with parts exploded of a cable connector.

With reference to FIGS. 1, 5 and 6, a cable connector 1 comprises, a housing block 2, at least one electrical cable 3 connected to signal contacts 4 and a reference conductor 5 extending beside the signal contacts 4, and a housing 6 having multiple contact positions 7 grouped in a row 8. All of the electrical cables 3 shown in FIG. 1 can be bundled together and considered as a single, composite cable 3. All of the housing blocks 2 of the composite cable 3 are mounted together with the housing 6 and considered as a single, composite housing block 2. The housing 6 is to be coupled to the housing block 2 and receives each signal contact 4 in one of the multiple contact positions 7 in the housing 6. The reference conductor 5 extends in the housing 6 beside each one of the multiple contact positions 7. The multiple contact positions 7 are provided by cavities in the housing 6. A slot 9 in the housing 6 receives the reference conductor 5. A reference contact 10 is received in the housing 6, along a passage 11, for example, in the housing 6, and is connected to the reference conductor 5. A finger 12 of the reference conductor 5 is connected to the reference contact 10.

Figure 2:
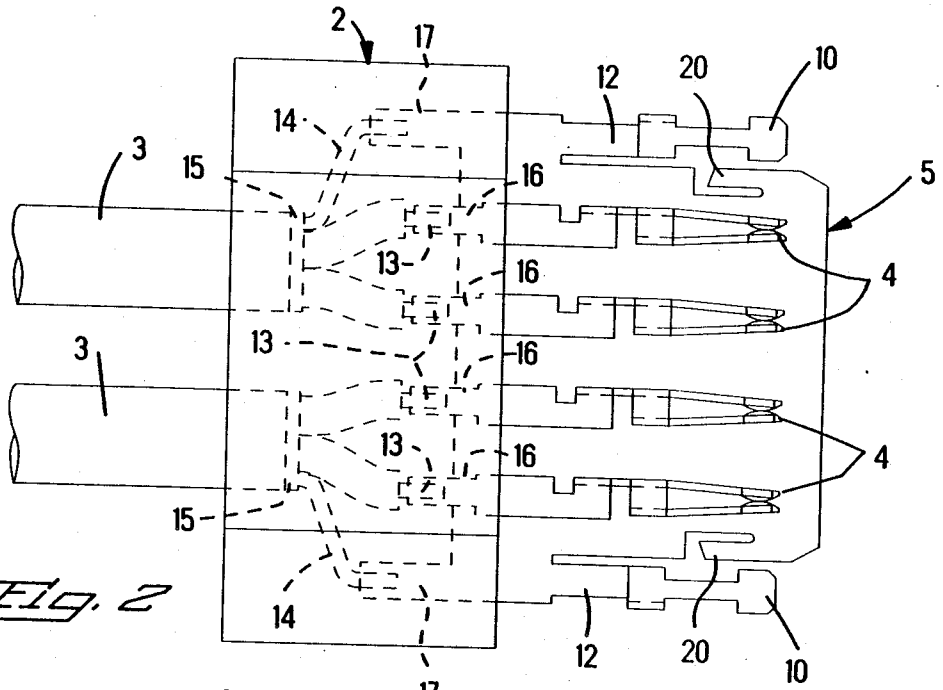
FIG. 2 is a plan view of a cable terminated with a housing block and electrical signal contacts and an electrical reference conductor.
Figure 3:
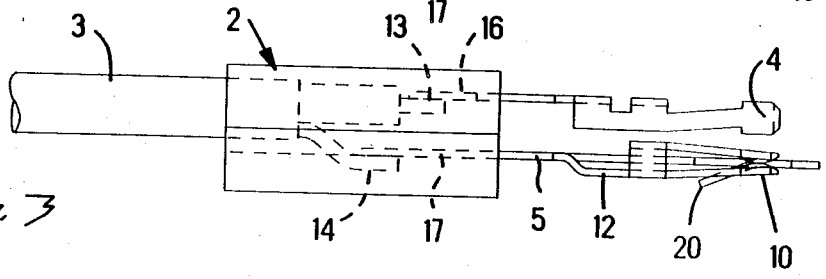
FIG. 3 is a side view of the structure shown in FIG. 2.
Figure 10:
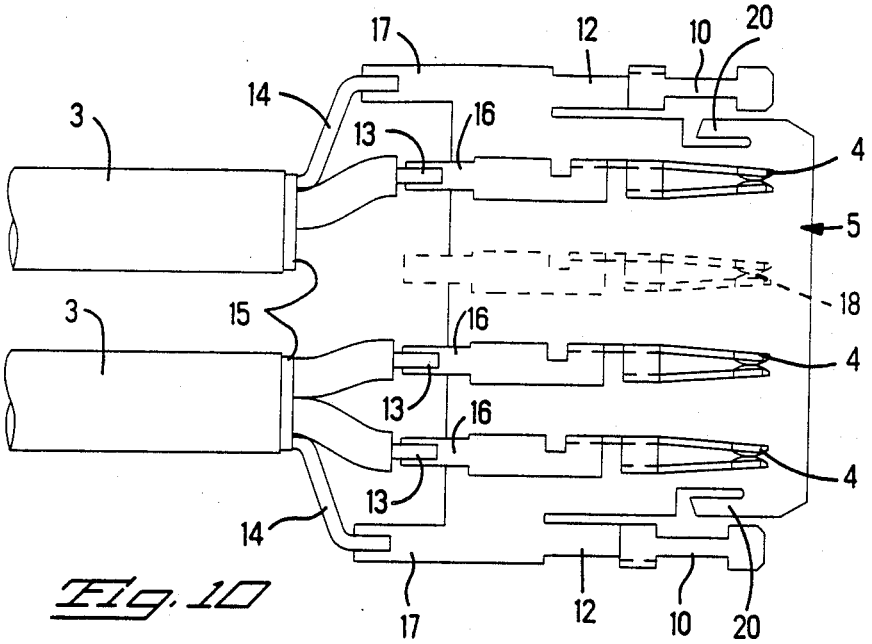
FIG. 10 is a view similar to FIG. 2, illustrating an alternative structure of signal contacts shown in FIG. 2.

A representative cable 3 is shown in FIGS. 2 and 10, and has at least one signal wire 13, although two signal wires 13 are shown, and at least one reference wire 14 for connection to an electrical reference potential, not shown. Each signal wire 13 is insulated and is connected to a corresponding signal contact 4 on the housing block 2 and provides a structure for disconnectable connection of the signal wire 13. Conductive shielding 15 of the cable 3 encircles the signal wires 13 and engages the reference wire 14 that is uninsulated. The cable 3 can have other forms, in which the number of corresponding signal wires 13 varies, the number of corresponding reference wires 14 varies, and the shielding 15 may not be present or may encircle each signal wire 13 individually. The corresponding reference wire 14 referred to herein is any conductive part of a representative cable 3, such as the cable 3, intended to be connected electrically to a reference electrical potential, and comprises any one of the following, a separate reference wire 14 known as a drain wire or a ground wire of the cable 3, a selected signal wire 13 of the cable 3 that is selected for connection to a reference electrical potential, or a conductive shielding 15 along the cable 3. The reference electrical potential can be electrical ground voltage or a voltage other than ground.

Each signal contact 4 includes a front, electrical receptacle and a rear wire connecting portion 16 connected to a conductive portion of a corresponding signal wire 13. Each corresponding reference wire 14 is connected to a corresponding wire connecting portion 17 of the reference conductor 5. Means for connecting the signal wire 13 to the signal contact 4 or for connecting the reference conductor 5 to the reference wire 14 include a solder connection, a weld connection or a compression crimp connection.

The housing block 2 is an insulative plastics material, for example, that is injection molded or otherwise formed to cover the wire connecting portions and is solidified. The signal contacts 4 on the housing block 2 are held in position for alignment with corresponding contact positions in the housing 6. The reference conductor 5 is held in position for insertion into the housing 6 with the signal contacts 4.

The reference conductor 5 is a conductive, flat metal plate having a front that projects forward at least as far as the front of each signal contact 4. The reference conductor 5 extends beside each signal contact 4 and provides an electrostatic and electromagnetic coupling across a coupling span bridging a space between each signal contact 4 and the reference conductor 5. Each of the signal contacts 4 and the contact positions are provided with a direct and strong coupling with the reference conductor 5. Thereby, the contact positions can be close together along the row 8 without an intervening low inductance return path. Signals that would detrimentally couple if routed to directly adjacent contact positions, can be spaced further apart by routing to other contact positions. There can even be an empty contact position 18, as shown in FIG. 10, in phantom outline, separating a single signal wire 13 of a corresponding cable 3 from two signal wires 13 of another cable 3. Thus, the multiple contact positions 7 can be close together, since they provide multiple choices for spacing apart signals that would be too close together if routed to directly adjacent contact positions 7 in the same row 8.

The reference conductor 5 at the front is received in the housing 6 beside each of the multiple contact positions 7. Each reference contact 10 at the front is received in the housing 6 along the passage 11 in the housing 6, and is connected to the reference conductor 5. For example, the finger 12 is unitary with the reference contact 10 and the reference conductor 5. Thus, the reference contact 10 is secured to the reference conductor 5. Further, the reference contact 10 is received by the housing 6 with the reference conductor 5.

Figure 12:
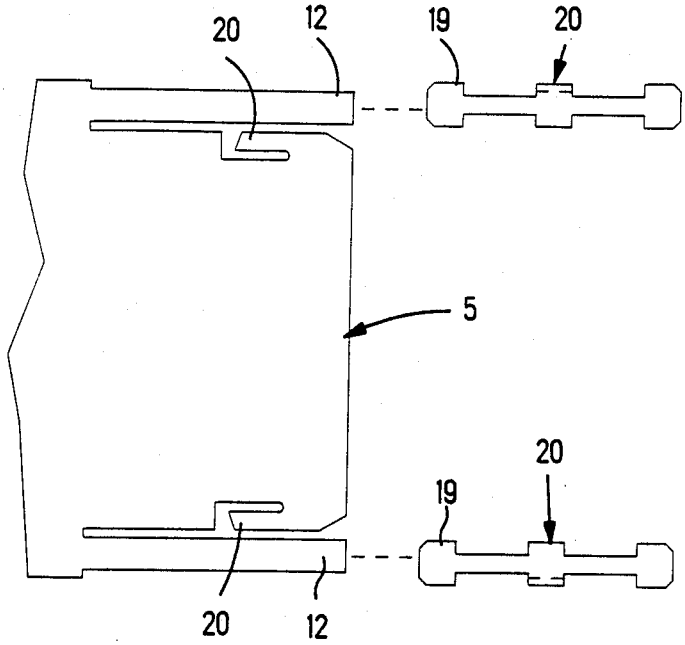
FIG. 12 is a view similar to FIG. 2, illustrating an alternative structure of the reference conductor shown in FIG. 2.

The reference contact 10 can also be a separate part, as shown in FIG. 12, and received in the housing 6 to make a disconnectable connection to the reference conductor 5 as the reference conductor 5 is received by the housing 6. The reference contact 10 can be constructed with a rear facing, receptacle type electrical contact 19, similar to the front receptacle type electrical contact described previously. The reference contact 10, with its contact 19, is in the housing 6 and disconnectably connects to the reference conductor 5.

Figure 8:
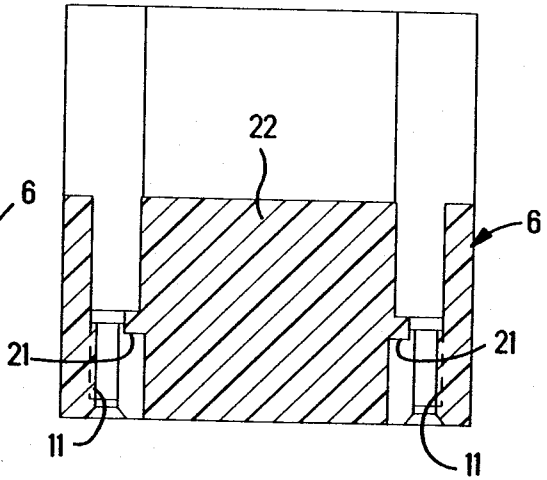
FIG. 8 is a section view taken along the line 8—8 of FIG. 6.
Figure 7:
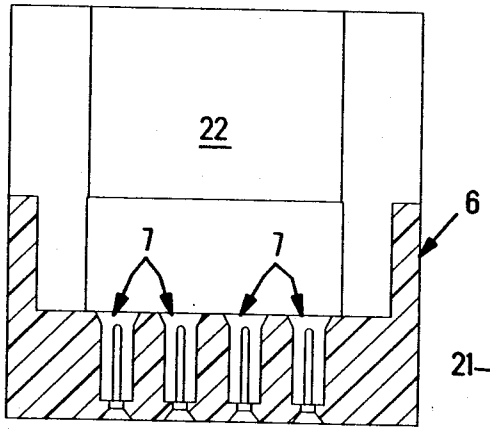
FIG. 7 is a section view taken along the line 7—7 of FIG. 6.

The reference contact 10 of each of FIGS. 2 and 12, is positioned in the housing 6 externally of the coupling span between each contact position and the reference conductor 5, advantageously allowing close spacing between the reference conductor 5 and each of the contact positions. The reference conductor 5 is in a plane, and the reference contact 10 is in the plane. A lance 20 extends from each lateral edge of the reference conductor 5 and latches against an interior undercut wall 21, FIG. 8, of the slot 9 in the housing 6. Since the signal contacts 4 and the reference conductor 5 project forwardly outward from the housing block 2, the housing 6 includes rear projecting insulative walls 22 defining a cavity 23 receiving a respective reference conductor 5. Pairs of the insulative walls 22 cover both sides of the projecting front of the reference conductor 5 and become engaged against a front end of the housing block 2. The two outermost walls 22 are longer than the others and do not engage the front end of a corresponding housing block 2. Instead, the longer walls 22 provide end walls of the housing 6.

An exterior of the reference conductor 5 extends uncovered along the housing block 2 and provides a shield for each signal contact 4 on the housing block 2 from detrimental electromagnetic and electrostatic voltages impressed on the exterior of the reference conductor 5. The uncovered exterior allows for nesting directly against another housing block 2 on which are additional signal contacts 4. The advantages are, that the housing blocks 2 are close together, and the signal contacts 4 on the housing blocks 2 are directly adjacent and close together without undue coupling with one another, because the reference conductor 5 provides a common return path for signal contacts 4 on one housing block 2, and provides a shield for each signal contact 4 on the one housing block 2 from each signal contact 4 on the adjacent housing block 2. Thus, the multiple contact positions 7 are grouped in at least two rows 8 of multiple contact positions 7 in the housing 6, the reference conductor 5 extends between two rows of signal contacts 4 aligned with corresponding multiple contact positions 7, each row of signal contacts 4 is on a corresponding housing block 2, and the reference conductor 5 extends along the corresponding housing block 2 and between the rows of signal contacts 4.

Figure 4:
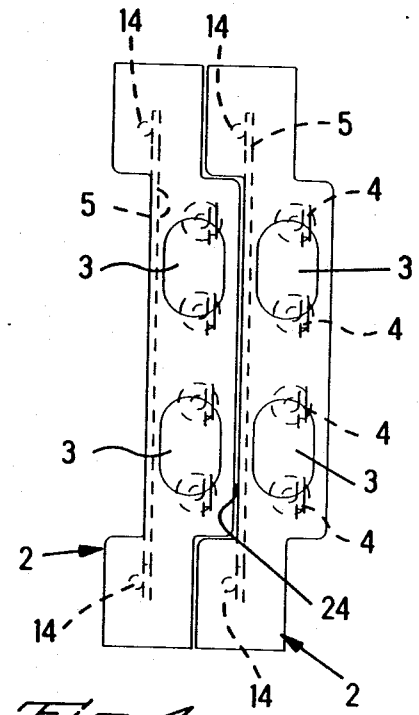
FIG. 4 is an end view of the structure shown in FIG. 2 together with a duplicate of the structure.
Figure 9:
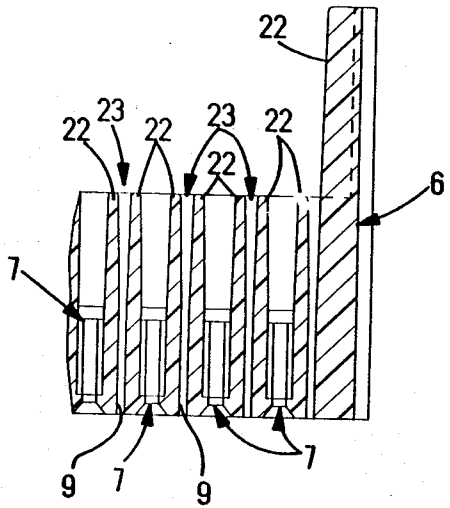
FIG. 9 is a section view taken along the line 9—9 of FIG. 6.

The reference conductor 5 is along a space 24, FIG. 4, alongside adjacent housing blocks 2. The adjacent housing blocks 2 can be separate. Further, two, or more than two, housing blocks 2 can be unitary or otherwise joined together and formed with a corresponding space 24 between rows of the signal contacts 4. The space 24 is inset within an inset side of the housing block 2 facing an adjacent housing block 2. The adjacent housing block 2 nests in the space 24 opposite the uncovered exterior of the reference conductor 5.

Figure 13:
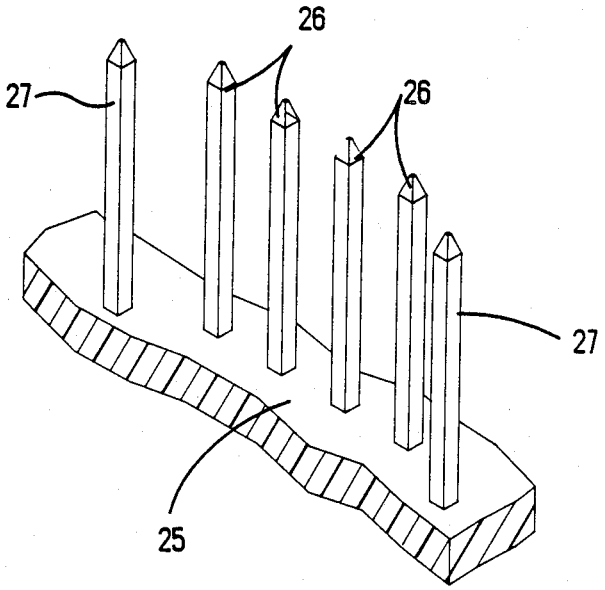
FIG. 13 is a fragmentary perspective view of a circuit board with representative contact pins.

The housing 6 can be a header type cable 3 connector 1 or a disconnectable cable 3 connector 1. The housing 6, when serving as a header, is mounted on a circuit board 25, FIG. 13, with conductive contact pins 26, 27 arranged, for example, in columns and rows. Only a few of the pins 26, 27 are shown in the Figure. Some of the pins 26, 27 are signal pins 26 that extend into corresponding contact positions 7 of the housing 6 for disconnectable connection with corresponding signal contacts 4. Others are reference pins 27 connected to a reference electrical potential, not shown, for example, a circuit that extends along the circuit board 25. Each corresponding reference pin 27 extends into a corresponding passage 11 of the housing 6 for disconnectable connection to a corresponding reference contact 10. The housing block 2 is assembled into the housing 6, to connect the signal pins 26 to corresponding signal wires 13 of the cable 3, and to connect the reference pins 27 to the reference conductor 5 and to the corresponding reference wire 14 of the cable 3. The housing block 2, the cable 3, the signal contacts 4 and the reference conductor 5 are removable from the housing 6 for repair or replacement, leaving the housing 6 in place on the circuit board and serving as a header for the housing block 2.

The housing 6, when serving as a disconnectable cable 3 connector 1, is disconnectable from the corresponding pins 26, 27, together with the housing block 2, and remains coupled to the housing block 2. Thereafter, the housing 6 can be separated from the housing block 2, the cable 3, the signal contacts 4 and the reference conductor 5 for ease in repair or replacement.

Figure 11:
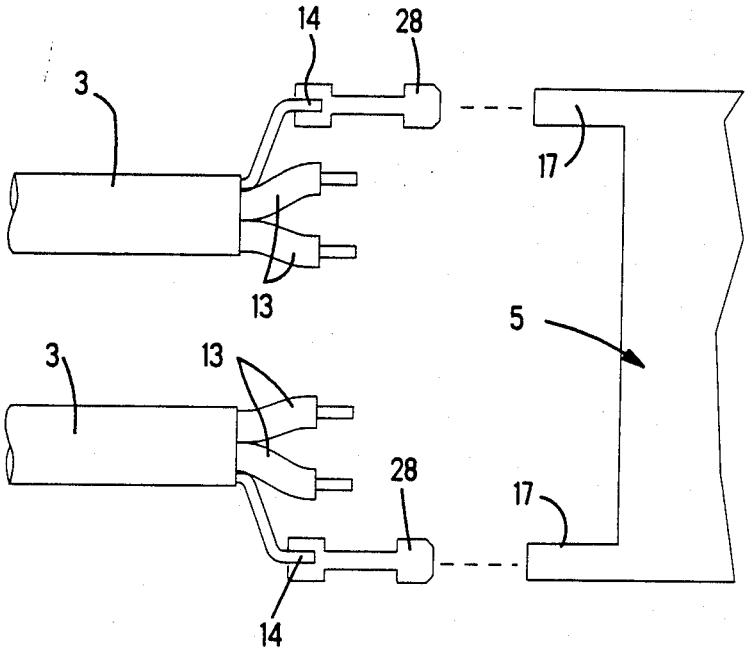
FIG. 11 is a view similar to FIG. 2, illustrating an alternative structure of a reference conductor shown in FIG. 2.

As shown in FIG. 11, the reference conductor 5 can have the wire connecting portions 17 separate from corresponding reference wires 14. The reference wires 14 can be connected to corresponding receptacle type, electrical contacts 28, similar to the receptacle type electrical contacts described previously. The receptacle type contacts 28 provide means for connecting the reference conductor 5 with the corresponding reference wires 14. The reference conductor 5 is then releasably held by the housing block 2 and the reference conductor 5 is disconnectably connected to the reference wires 14 by the contacts 28, and remains in place within the housing 6 when the housing block 2. The housing block 2 and the cable 3 and the signal contacts 4 are then disconnectable from the housing 6 and the reference conductor 5 for ease in repair or replacement.

Each of the advantages and features of the invention is useful independently of the others.

We claim:

1. A cable connector, comprising, a housing block, an electrical cable having at least one signal wire connected to a corresponding signal contact on the housing block, at least one reference wire of the cable for connection to a reference electrical potential, wherein the improvement comprises:

a reference conductor extending beside the signal contact and having a front that projects forward at least as far as a front of the signal contact, means connecting the reference conductor to the reference wire, an insulative housing coupled to the housing block, the front of the signal contact being received in one of multiple contact positions in the housing, the front of the reference conductor being received in the housing and extending beside each of the multiple contact positions, a reference contact being received in the housing and being connected to a portion of the reference conductor positioned in the housing externally of a coupling span between the front of the signal contact and the front of the reference conductor.

2. A cable connector as recited in claim 1 comprising:

an exterior of the reference conductor extending uncovered along the housing block and providing a shield for each signal contact on the housing block from detrimental electromagnetic and electrostatic voltages impressed on the exterior of the reference conductor.

3. A cable connector as recited in claim 1, comprising: the reference conductor being in a plane, and the reference contact is in the plane.

4. A cable connector as recited in claim 1, comprising: the reference conductor projecting forwardly from the housing block and beside the signal contact, the signal contact also projecting forwardly from the housing block.

5. A cable connector as recited in claim 1, comprising: the reference conductor latches to the housing.

6. A cable connector as recited in claim 1, comprising: the reference contact being secured to the reference conductor and being received by the housing with the reference conductor.

7. A cable connector as recited in claim 1, comprising the multiple contact positions being grouped in at least two rows of multiple contact positions in the housing, and the reference conductor extending between the two rows.

8. A cable connector as recited in claim 2, comprising: the reference contact being secured to the reference conductor and being received by the housing with the reference conductor.

9. A cable connector as recited in claim 2, comprising: the reference conductor is in a plane and the reference contact is in the plane.

10. A cable connector as recited in claim 2 comprising: the reference conductor projecting forwardly from the housing block and beside the signal contact, the signal contact also projecting forwardly from the housing block.

11. A cable connector as recited in claim 2, comprising: the multiple contact positions being grouped in at least two rows of multiple contact positions in the housing, the reference conductor extending between the two rows.

12. A cable connector as recited in claim 2, comprising: the reference conductor latches to the housing.

13. A cable connector, comprising:

a housing block, an electrical cable having at least one signal wire connected to a corresponding signal contact on the housing block, at least one reference wire of the cable for connection to a reference electrical potential, a reference conductor extending beside the signal contact, means connecting the reference conductor to the reference wire, a housing coupled to the housing block and receiving the signal contact in one of multiple contact positions in the housing, a reference contact being received in the housing and being connected to the reference conductor, the reference conductor extending in the housing and extending beside each one of the multiple contact positions, the reference conductor disconnects from the housing block upon separation of the housing block from the housing, and the connecting means being readily disconnectable from the reference conductor.

14. A cable connector, comprising:

a housing block, an electrical cable having at least one signal wire connected to a corresponding signal contact on the housing block, at least one reference wire of the cable for connection to a reference electrical potential.

a reference conductor extending beside the signal contact, means connecting the reference conductor to the reference wire, a housing coupled to the housing block and receiving the signal contact in one of multiple contact positions in the housing, a reference contact being received in the housing and being connected to the reference conductor, the reference conductor extending in the housing and extending beside each one of the multiple contact positions, the reference contact being in the housing and readily disconnectably connecting to the reference conductor.

15. A cable connector, comprising:

a housing block, an electrical cable having at least one signal wire connected to a corresponding signal contact on the housing block, at least one reference wire of the cable for connection to a reference electrical potential, a reference conductor extending beside the signal contact, means connecting the reference conductor to the reference wire, a housing coupled to the housing block, the signal contact being received in one of multiple contact positions in the housing, the reference conductor being received in the housing beside each of the multiple contact positions, a reference contact being received in the housing and being connected to the reference conductor, the reference contact being positioned in the housing externally of a coupling span between each contact position and the reference conductor.

the reference conductor disconnects from the housing block upon separation of the housing block from the housing, and the connecting means being readily disconnectable from the reference conductor.

16. A cable connector, comprising:

a housing block;

an electrical cable having at least one signal wire connected to a corresponding signal contact on the housing block, at least one reference wire of the cable for connection to a reference electrical potential, a reference conductor extending beside the signal contact, means connecting the reference conductor to the reference wire, a housing coupled to the housing block, the signal contact being received in one of multiple contact positions in the housing, the reference conductor being received in the housing beside each of the multiple contact positions, the reference contact being positioned in the housing externally of a coupling span between each contact position and the reference conductor, the reference contact being in the housing and readily disconnectably connects to the reference conductor.

17. A cable connector, comprising:

a housing block, an electrical cable having at least one signal wire connected to a corresponding signal contact on the housing block, at least one reference wire of the cable for connection to a reference electrical potential, a reference conductor extending beside the signal contact, means connecting the reference conductor to the reference wire, a housing coupled to the housing block, the signal contact being received in one of multiple contact positions in the housing, the reference conductor being received in the housing beside each of the multiple contact positions, a reference contact being received in the housing and being connected to the reference conductor, the reference contact being positioned in the housing externally of a coupling span between each contact position and the reference conductor, the reference conductor being in a plane, and the reference contact being in the plane.

18. A cable connector, comprising:

a housing block, an electrical cable having at least one signal wire connected to a corresponding signal contact on the housing block, at least one reference wire of the cable for connection to a reference electrical potential, a reference conductor extending beside the signal contact, means connecting the reference conductor to the reference wire, a housing coupled to the housing block, the signal contact being received in one of multiple contact positions in the housing, the reference conductor being received in the housing beside each of the multiple contact positions, a reference contact being received in the housing and being connected to the reference conductor, the reference contact being positioned in the housing externally of a coupling span between each contact position and the reference conductor, the reference conductor projecting forwardly from the housing block and beside the corresponding signal contact, and the signal contact also projecting forwardly from the housing block.

19. A cable connector, comprising:

a housing block, an electrical cable having at least one signal wire connected to a corresponding signal contact on the housing block, at least one reference wire of the cable for connection to a reference electrical potential, a reference conductor extending beside the signal contact, means connecting the reference conductor to the reference wire, a housing coupled to the housing block, the signal contact being received in one of multiple contact positions in the housing, the reference conductor being received in the housing beside each of the multiple contact positions, a reference contact being received in the housing and being connected to the reference conductor, the reference contact being positioned in the housing externally of a coupling span between each contact position and the reference conductor, and the reference conductor latching to the housing.

20. A cable connector, comprising:

a housing block, an electrical cable having at least one signal wire connected to a corresponding signal contact on the housing block, at least one reference wire of the cable for connection to a reference electrical potential, a reference conductor extending beside the signal contact, means connecting the reference conductor to the reference wire, an insulative housing coupled to the housing block, the signal contact being received in one of multiple contact positions in the housing, the reference conductor being received in the housing beside each of the multiple contact positions, an exterior of the reference conductor extending uncovered along the housing block and providing a shield for each signal contact on the housing block from detrimental electromagnetic and electrostatic voltages impressed on the exterior of the reference conductor, the reference conductor disconnects from the housing block upon separation of the housing block from the housing, and the connecting means being readily disconnectable from the reference conductor.

21. A cable connector, comprising:

a housing block, an electrical cable having at least one signal wire connected to a corresponding signal contact on the housing block, at least one reference wire of the cable for connection to a reference electrical potential, a reference conductor extending beside the signal contact, means connecting the reference conductor to the reference wire, an insulative housing coupled to the housing block, the signal contact being received in one of multiple contact positions in the housing, the reference conductor being received in the housing beside each of the multiple contact postions, an exterior of the reference conductor extending uncovered along the housing block and providing a shield for each signal contact on the housing block from detrimental electromagnetic and electrostatic voltages impressed on the exterior of the reference conductor, and a reference contact being received in the housing and readily disconnectably connecting to the reference conductor.

* * * * *